United States Patent [19]

Popp

[11] Patent Number: 4,658,907

[45] Date of Patent: Apr. 21, 1987

[54] FIRE EXTINGUISHER SAFETY PIN TAG HOLDER

[76] Inventor: Wayne A. Popp, 938 Crestland Dr., Ballwin, Mo. 63011

[21] Appl. No.: 815,065

[22] Filed: Dec. 30, 1985

[51] Int. Cl.[4] ..... A62C 23/08

[52] U.S. Cl. ..... 169/75; 24/155 R; 24/563; 40/11 R; 239/71; 248/302; 251/99; 251/104

[58] Field of Search ..... 169/75; 24/563, 543, 24/546, 155 R; 248/302; 239/71; 40/10 R, 11 R, 11 A, 341; 251/99, 102, 104

[56] References Cited

U.S. PATENT DOCUMENTS

| | | | |
|---|---|---|---|
| 1,975,178 | 10/1934 | Smith et al. | 251/104 |
| 2,091,053 | 8/1937 | Perkins | 40/11 A |
| 2,531,123 | 11/1950 | Guise | 169/75 |
| 2,694,456 | 11/1954 | Huthsing | 169/75 |
| 3,061,014 | 10/1962 | Forrester et al. | 169/75 |
| 3,463,235 | 8/1969 | Flajole | 169/75 |
| 3,666,016 | 5/1972 | Estes | 169/75 |
| 3,702,637 | 11/1972 | Bower | 169/75 |
| 4,088,194 | 5/1978 | Hard | 169/75 |

*Primary Examiner*—Andres Kashnikow
*Assistant Examiner*—Michael J. Forman
*Attorney, Agent, or Firm*—Glenn K. Robbins

[57] ABSTRACT

A safety pin for fire extinguishers. The pin has a prong interfitted in registering holes of the extinguisher to prevent operation until removed by grasping a finger loop and extracting the pin. The finger loop is connected to a stabilizer extension of the pin fitting over the top of the trigger and biased against it to present the loop in a preselected upright position for ready access by the user. The stabilizer extension may be formed as a stabilizer loop bearing against the top of the trigger to prevent the rotation of the pin. The pin may be further provided with an upright standard extending above the trigger to receive an inspection tag or the like.

12 Claims, 7 Drawing Figures

FIRE EXTINGUISHER SAFETY PIN TAG HOLDER

BACKGROUND OF THE INVENTION

In the past safety pins have been conventionally provided for fire extinguishers. Such safety pins have been comprised of a pin fitting through registering holes in the fire extinguisher trigger to block the operation against accidental operation until the pin is extracted. A finger loop is usually provided at one side of an end of the pin for grasping by the user in the removal process.

Such safety pins have presented difficulty in the past because of problems in ready access to the loop. The loop is because of the rotatability of the pin usually presented in a downward position adjacent the fire extinguisher gauge and it is somewhat awkward to remove the pin particularly where substantial force is required to break a pin barb which is often employed.

Further problems with fire extinguishers have been presented in the use of inspection tags. Such tags are used to provide information as to the condition of the fire extinguisher charge, the date of last inspection and like information. The placement of such tags usually by a wire or the like connecting the tag to same part of the extinguisher or posted in an area adjacent the extinguisher varies greatly depending on the local custom and detracts from the speed, efficiency and consequent safety in such inspections.

SUMMARY OF THE INVENTION

By means of this invention there has been provided an improved safety pin for use with conventional fire extinguishers to present a finger loop in a stable non-rotatable position for ready access to the user. The finger loop may be enlarged over conventional safety pin loops for ease in grasping and presented in an upright position above the trigger where there is no interference with the gauge or other parts of the extinguisher.

The stabilizing feature of the safety pin which prevents rotation of the pin and the finger loop is provided by a springlike stabilizer extension at an end of the pin connected to the finger loop to fit over the tag of the trigger and bear against it in biasing relation. The extension stabilizer lays flat across the top of the trigger and prevents rotation of the finger loop. The stabilizer may be formed in the shape of a loop or wave shaped in order that it extend across the trigger but also bi-laterally to prevent the afore-said rotation.

The pin may be conventionally made of a single length of wire formed to provide the features described above. It will be understood that plastic of desirable stiffness and flexibility may also be employed.

In a modification the safety pin may be provided with a tag supporting standard connected to the stabilizer extension. The standard extends vertically above the trigger and provides a means for readily connecting an inspection tag or the like in plain view above the trigger. The standard may be provided with a horizontal arm receiving a tag having a sleeve at the top or a simple hook receiving a tag eyelet. The entire pin and standard may also be formed of a single length of wire or plastic.

The safety pin and modified pin with standard are rugged and simple to use with improved access which add to the very necessary safety feature in use.

The above features are object of this invention. Further objects will appear in the detailed description which follows and will be further apparent to those skilled in the art.

There is shown in the accompanying drawing a preferred embodiment and modifications of the instant invention for the purpose of illustration. It is to be understood that this is for the purpose of example and that the invention is not limited thereto.

IN THE DRAWING

DESCRIPTION OF THE INVENTION

Figure 1:
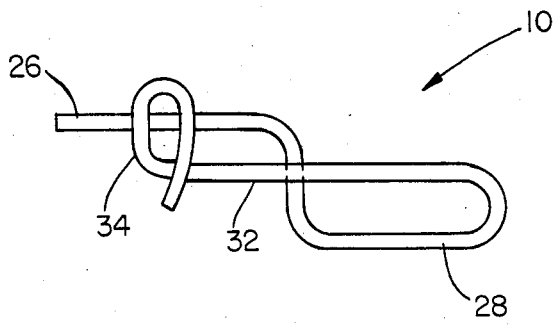
FIG. 1 is a top plan view of the fire extinguisher safety pin of this invention.
Figure 2:
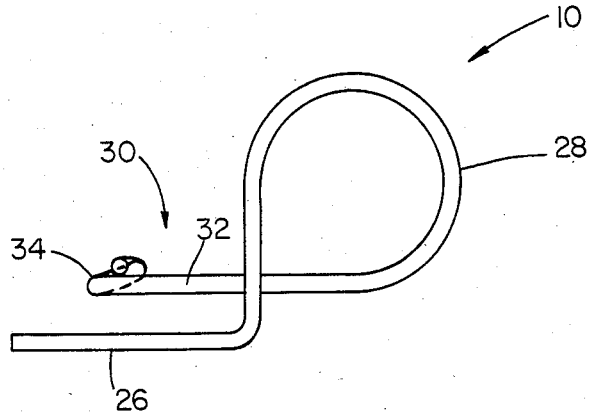
FIG. 2 is a view in front elevation.
Figure 3:
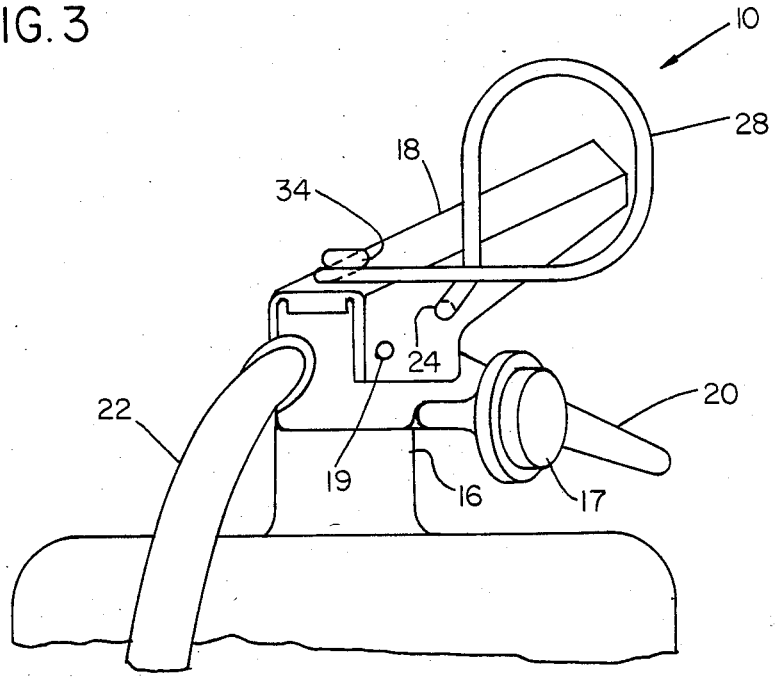
FIG. 3 is a pictorial view of the safety pin interfitted in the trigger of a fire extinguisher.

The pin of this invention is generally identified by the reference numeral 10 in FIGS. 1–3. It is shown interfitted with a fire extinguisher 12 in FIG. 3.

The fire extinguisher 12 is of conventional construction and forms no part of this invention, per se. It has a body 14, a head 16 which supports a pressure gauge 17 and a valve (not shown) underneath a pivotable trigger 18 pivotably supported by pivot pin 19. A handle 20 extends to the rear of the extinguisher while a discharge hose 22 extends to the front. The trigger is provided with registering holes 24 on both sides within which the safety pin may be inserted to prevent operation of the trigger. In some fire extinguishers the safety pin is blocked by the top of the handle and in others the handle may be provided with holes registrable with the trigger holes and receiving the safety pin. In both types the blocking action of the pin is the same.

The safety pin 10 may be formed of a single length of wire and is comprised of a pin section 26, a large finger loop section 28 and a stabilizer section 30. The finger loop is formed to extend above the trigger and is in a vertical plane for ready grasping by a user.

The stabilizer section is formed by an intermediate extension 32 connecting the finger loop to a stabilizer 34. The stabilizer is in the form of a loop and by the spring-like action of the extension 32 and the finger loop bears in biased relation against the top of the trigger. This biasing relation not only prevents rotation of the finger loop but also provides resistance to the pin accidentally falling out of the trigger while at the same time permitting easy withdrawal.

Figure 4:
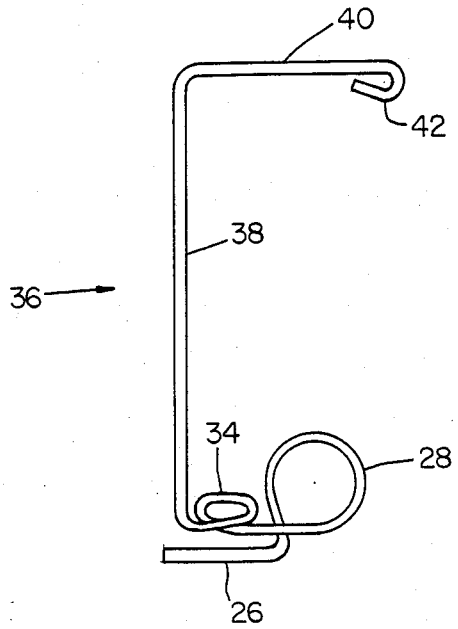
FIG. 4 is a view in front elevation of a modified safety pin.
Figure 5:
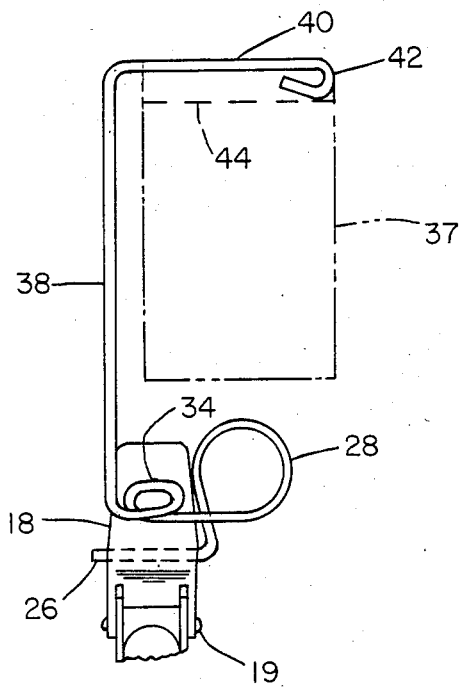
FIG. 5 is a view taken similarly to that of FIG. 4 with the safety pin interfitted in the trigger of a fire extinguisher and supporting an inspection tag.

A modified safety pin 36 is shown in FIGS. 4 and 5. This pin is designed to support an inspection tag 37 for ready viewing and access above the fire extinguisher. The construction may be identical to that of the aforementioned safety pin 10 with the addition of an upright standard or vertical support 38 formed as an extension of the stabilizer 32. A lateral arm 40 having a retaining loop 42 at the end is employed to be received within a sleeve 44 of the inspection tag.

Figure 6:
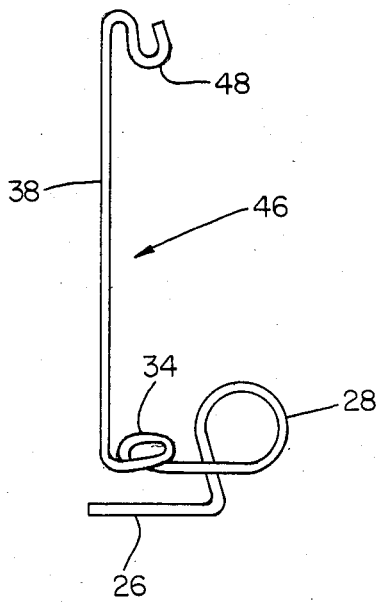
FIG. 6 is a view in front elevation of a further modified safety pin.
Figure 7:
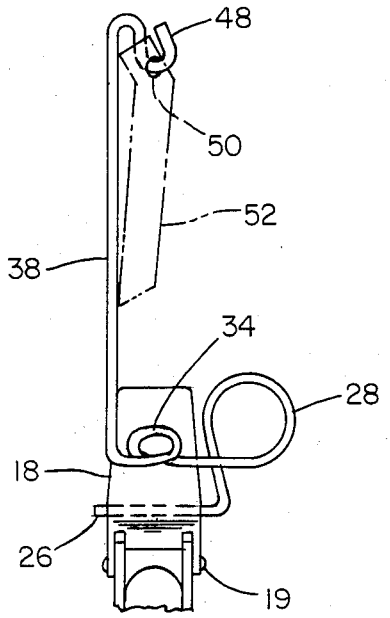
FIG. 7 is a view taken similarly to that of FIG. 6 with the safety pin interfitted in the trigger of a fire extinguisher and supporting an inspection tag.

A further modified safety pin 46 is shown in FIGS. 6 and 7. This pin like the pin 36 is formed as a continuation of the safety pin 10 and employs a vertical tag standard or support 38. The top of the standard has a hook 48 which receives an eyelet 50 of an inspection tag 52.

USE

The safety pin of this invention is employed in much the same manner as the conventional pin used in the past but with the advantage of ease of access to the finger loop.

For insertion in the trigger the straight pin extension 26 is simply alinged with the registering holes 19 in the trigger while spreading apart the stabilizer 34 to fit over the top of the trigger. When the pin extension is fully inserted the stabilizer is released to bear by its spring force against the top of the trigger where it is maintained by its biasing action. The finger loop is presented in the upright position where it is held in stable relation and is readily accessible.

When the extinguisher is needed for use in an emergency situation the user can grasp the finger loop and extract the pin in a minimum of hunt and pull time. This frees the trigger for operation of the fire extinguisher as required.

The modified safety pin 36 is fitted to the fire extinguisher in a similar fashion to that described above. When so fitted a tag 37 may be simply supported upon the standard 38 by inserting the lateral arm 40 through the sleeve 44 of the tag. The inspection tag identification is readily visible for necessary review. The tag may be readily replaced as necessary or updated as required. Removal of the pin when the extinguisher is required for emergency use is effected as in the safety pin 10 by simply grasping the finger loop and pulling the pin out of the extinguisher to free the trigger for operation of the extinguisher.

The further modified safety pin 46 is likewise employed in a similar manner to that described for the safety pins 10 and 36. The inspection tag is supported from the standard 38 by the hook 48 which is received in the eyelet 52 of tag 50. This modification provides a means for supporting such conventional eyelet provided tags which are commonly employed in the industry.

Various changes and modifications may be made within this invention as will be apparent to those skilled in the art. Such changes and modifications are within the scope and teaching of this invention as defined in the claims appended hereto.

What is claimed is:

1. A fire extinguisher safety pin for use with fire extinguishers having a trigger provided with registering holes receiving the pin for blocking the operation of said trigger, said safety pin having a pin section receivable in said registering holes of the trigger, a finger loop means connected to said pin section and extending above said pin section in a vertical plane and laterally extending stabilizing means biased against a top surface of the trigger to prevent the rotation of said finger loop means, said stabilizing means being connected to said finger loop means and extending over and biased against a top of the trigger.

2. The fire extinguisher safety pin of claim 1 in which said finger loop means extends above said trigger.

3. The fire extinguisher safety pin of claim 2 in which the safety pin is formed of a single length of wire.

4. The fire extinguisher safety pin of claim 3 in which the stabilizing means is in the form of a loop adapted to lay flat against the top of the trigger.

5. The fire extinguisher safety pin of claim 1 in which the stabilizing means is in the form of a loop adapted to lay flat against the top of the trigger.

6. The fire extinguisher safety pin of claim 1 in which the safety pin is formed of a single length of wire.

7. The fire extinguisher safety pin of claim 6 in which a vertical tag standard is connected to an end of said stabilizing means, said standard having means supporting an inspection tag and said standard extending above said fire extinguisher a sufficient distance to support said inspection tag above said fire extinguisher.

8. The fire extinguisher safety pin of claim 1 in which a vertical tag standard is connected to an end of said stabilizing means, said standard having means supporting an inspection tag.

9. The fire extinguisher safety pin of claim 8 in which said standard extends above said fire extinguisher a sufficient distance to support said inspection tag above said fire extinguisher.

10. The fire extinguisher safety pin of claim 8 in which the standard is provided with a laterally extending arm adapted to be inserted in a sleeve provided in a top portion of a tag to be supported upon said arm.

11. The fire extinguisher safety pin of claim 10 in which a free end of said arm has an enlarged portion approximating the internal size of said sleeve to serve as a retaining means against accidental dislodgement.

12. The fire extinguisher safety pin of claim 8 in which the standard is provided with a hook member at a top portion of said standard, said hook receiving a tag with an eyelet.

* * * * *